US009731187B2

(12) United States Patent
Hurth

(10) Patent No.: US 9,731,187 B2
(45) Date of Patent: Aug. 15, 2017

(54) CONNECTION UNIT

(71) Applicant: Peter Hurth, Neu-Anspach (DE)

(72) Inventor: Peter Hurth, Neu-Anspach (DE)

( * ) Notice: Subject to any disclaimer, the term of this patent is extended or adjusted under 35 U.S.C. 154(b) by 0 days.

(21) Appl. No.: 14/414,019

(22) PCT Filed: Jun. 28, 2013

(86) PCT No.: PCT/EP2013/063579

§ 371 (c)(1),
(2) Date: Mar. 9, 2015

(87) PCT Pub. No.: WO2014/009170

PCT Pub. Date: Jan. 16, 2014

(65) Prior Publication Data

US 2015/0209649 A1 Jul. 30, 2015

(30) Foreign Application Priority Data

Jul. 11, 2012 (DE) ..... 10 2012 106 225

(51) Int. Cl.
*A63C 5/16* (2006.01)

(52) U.S. Cl.
CPC ..... *A63C 5/16* (2013.01)

(58) Field of Classification Search
None
See application file for complete search history.

(56) References Cited

U.S. PATENT DOCUMENTS

| | | | | |
|---|---|---|---|---|
| 6,682,083 | B2 * | 1/2004 | Melcher | A63C 5/033 280/14.26 |
| 7,484,738 | B2 * | 2/2009 | Belt | A63C 5/031 280/14.26 |
| 8,033,564 | B2 * | 10/2011 | Riepler | A63C 5/02 280/603 |
| 8,708,371 | B2 * | 4/2014 | Balun | A63C 5/033 280/14.21 |
| 2003/0155726 | A1 * | 8/2003 | Braun | A63C 5/02 280/14.21 |

FOREIGN PATENT DOCUMENTS

| | | |
|---|---|---|
| CH | 703831 | 3/2012 |
| DE | 2247154 | 4/1973 |
| DE | 102004063031 | 7/2006 |
| DE | 102007034228 | 1/2009 |
| WO | WO0166203 | 9/2001 |
| WO | WO2012038554 | 3/2012 |

* cited by examiner

*Primary Examiner* — John Walters
*Assistant Examiner* — Hilary L Johns
(74) *Attorney, Agent, or Firm* — Head, Johnson, Kachigian & Wilkinson, PC

(57) ABSTRACT

A restricted, preferably spring elastic and dampened movability of transversal struts (5*a, b*) in the longitudinal direction (10) with respect to a skid (2*a*) supporting the transversal struts prevents a transmission and build-up of vibrations through the connection units (3) at the piece of winter sports equipment (1).

22 Claims, 8 Drawing Sheets

CONNECTION UNIT

I. FIELD OF THE INVENTION

Figure 1A:
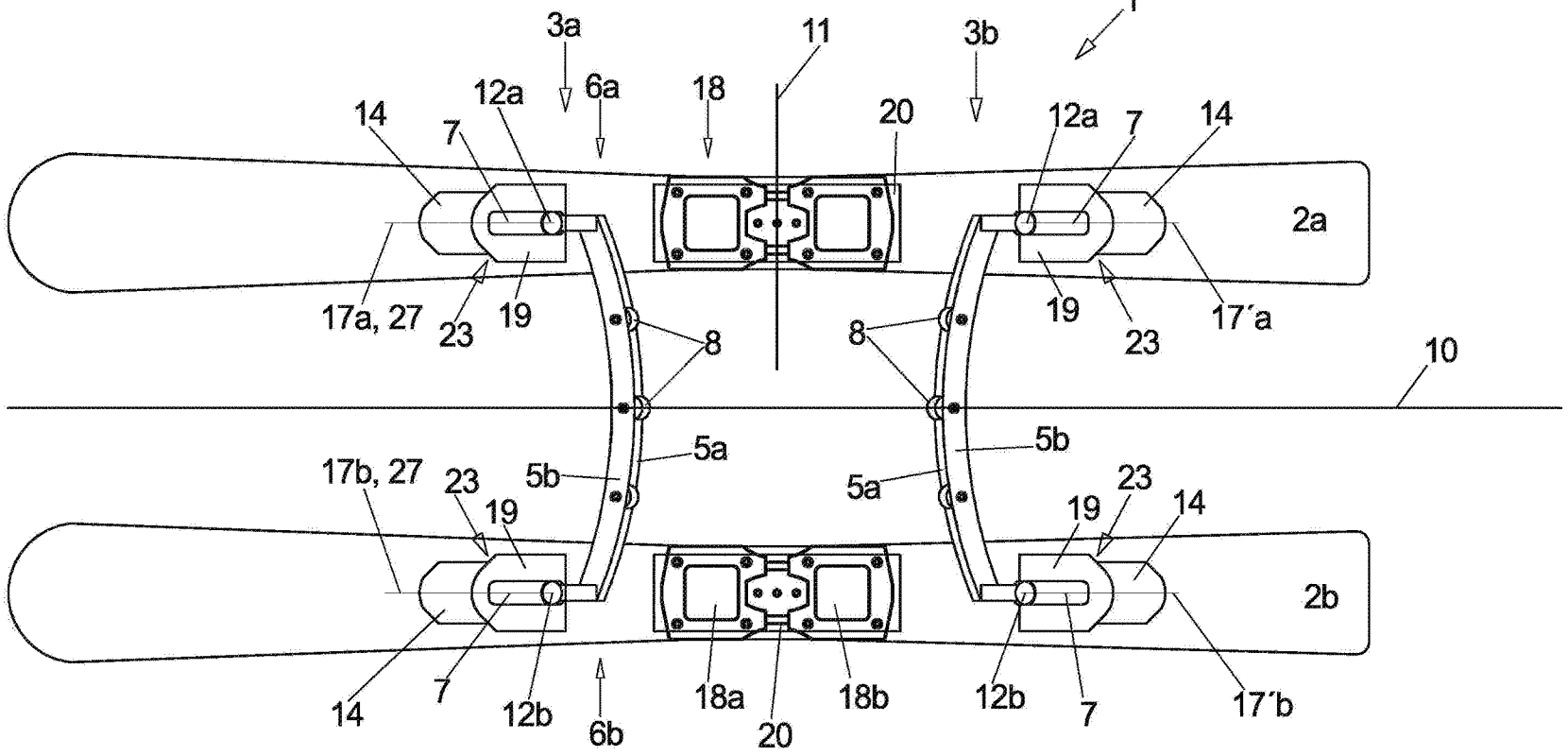

The invention relates to a connection unit moveably connecting two skis extending adjacent to one another in a longitudinal direction.

II. BACKGROUND OF THE INVENTION

Many types of winter sport equipment are available today which are used for sliding on snow covered or ice covered slopes. A differentiation has to be made with one ski or with plural skis and within winter sport equipment with two skis a differentiation has to be made whether the skis can be operated by the user independently from one another or not.

The typical case of a piece of winter sport equipment with two skids that can be operated independently from one another is a pair of skis where one respective ski is firmly connected through a binding with a foot. From this for example the mono ski was derived that is configured with only one skid wherein both legs/feet are attached to the only one skid.

Another embodiment of a piece of winter sport equipment with only one skid is a snowboard whose track is only run on one edge. The fixated position of the feet on the mono ski and also on the snowboard however partially also has undesirable side effects like e.g. one sided loading of a person's muscles. In order to combine the fascination of swinging on one edge with a comfort of two independent skis two ski systems were developed which unite the positive effects of the different systems in a synthesis.

Based on the idea to run two edges together in one track connection units were and systems were developed which run two skis in parallel.

Herein various categories can be differentiated which shall satisfy different requirements.

1. connection units for running ski tips in parallel and to prevent skis from crossing over.
2. connection units for parallel fixation of the skis to form a mono ski.
3. connection units for parallel support of the skis with an ability to edge and step movement along the longitudinal axis of the ski.

Such extensions to the ski material furthermore also provide new movement qualities and new driving techniques. A currently preferred movement quality is formed by the movement dynamics of turns that are driven like on a rail which are also known as carving turns.

A characterizing feature of these carving turns is the parallel ski position and the higher speed and the strong to extreme turn angulation.

All the above lead to a strong bending of the skis. The energy stored in the ski through the strong bending in turn provides reset forces which are used by good skiers to turn the ski.

Using these reset forces which are also designated rebound provides a very economic turn technique which however requires a high level of movement skill. Only high edge angles and G forces provide that the ski is bent to a high extent.

It is an object of the invention to make this fascinating and economical ski technique available to a large number of beginners and intermediate skiers.

In this context it is already known from DE 10 2007 034 228 that each of the two connection units is provided with two parallel transversal struts in front and behind the ski bindings and to use elastic elements like rubber blocks between the transversal struts which cause a reset force towards a normal position of both skis relative to one another for each edge application.

However, also this solution does not solve the general problem that to a higher extent vibrations that are caused by the ground are introduced into a skid and are transferred through the connecting mechanism to the other skid, the better and the stronger the connection between the two skids.

III. DETAILED DESCRIPTION OF THE INVENTION a) Technical Object

Thus, it is an object of the invention to provide a connection unit of this general type which can be produced in a simple and cost effective manner and which transfers vibrations caused by the ground as little as possible from one skid to the other skid. Additionally the connection units shall be advantageously removable from the skis.

b) Solution

The object is achieved by the features of claims 1, 19 and 23. Advantageous embodiments can be derived from the dependent claims.

The key idea of the invention is to run a piece of winter sport equipment with two skids adjacent to one another wherein the two skids are respectively mechanically connected with one another in a front portion and in a rear portion in transversal direction so that the two skids are vibration decoupled, thus jolts and vibrations which are introduced into one skid by the ground during skiing are not transmitted or only transmitted in a reduced form to the other skids.

Additionally advantageously the mechanical transversal connection shall be provided so that edging one skid causes edging of the other skid as a consequence.

Furthermore the mechanical transversal connection can be provided so that a longitudinal movement of the sliding skids relative to one another can be performed as a step movement.

Through the attachment of the transversal strut that is moveable in longitudinal direction and/or in transversal direction relative to the supporting sliding skid with a compensation device and in particular also the arrangement of a spring element and/or a damper element there between at each end of the connection unit certainly advantageously with an effective direction towards the move ability of the attachment of the transversal strut limited movements of the connection unit relative to the supporting skid are facilitated and in particular counter acted by a spring force and/or dampened. This prevents or at least strongly reduces an effect where forces which are caused by the connection unit and which come from the other skid cause undesirable vibrations or movements in the respective skid.

This compensation device is advantageously arranged between the support block and the respective skid since a comparatively large installation space is provided at this location for this purpose. Between the bearing block and the transversal skid a compensation device of this type is rather detrimental.

The spring element and the damper element can be separate elements or also a combined spring-/damper element (combo element), in the simplest case a block made from rubber or another elastic material.

The effective direction of the spring element and/or of the damper element, however, should advantageously coincide which can be achieved in the simplest manner for a combo element.

Advantageously movability and/or spring/damper effect should be provided also in the horizontal transversal direction in particular in ail directions, thus all three directions in space, wherein the effect in the vertical is less important.

A movability and thus spring absorption and damping only in the longitudinal and transversal direction already compensates almost all forces and movements that are transferred from one skid through the connection unit to the other skid.

A particularly simple but very effective variant is to provide a limited movability with spring absorption and damping only in longitudinal direction since the connection unit is almost never at an exactly right angle to the longitudinal direction jolts in a direction of the connection unit are transferred without problems into a longitudinal movement relative to the skid when the connection unit is at a slant angle relative to the longitudinal direction.

The maximum movability, in particular in longitudinal direction and also the movement path of the spring element and/or the damper element from an normal position should be +/−60 mm at the most, better +/−40 mm at the most, better +/−20 mm, at the most, however, at least +/−3 mm, better at least +/−10 mm, better at least +/−15 mm.

Advantageously the effect of the spring element and also the effect of the damper element should be adjustable in order to be able to adjust a behavior of the connection unit independently from a surface and environmental conditions.

In order to arrange the spring-/damper element the connection unit advantageously includes a base plate at each, end wherein the base plate can be screwed onto the skid, wherein the bearing block is advantageously supported in longitudinal direction at sliding supports of the base plate. Between the bearing block and the base plate the spring element and/or the damper element are arranged, for example in that the base plate includes recesses, for example in its end portion in longitudinal direction, wherein the recesses are respectively open towards its front side and back side. Therein blocks made from elastic material, like e. g. rubber can be inserted as spring-damper elements wherein a contact element of the bearing block contacts the blocks made from the elastic material when the bearing block is moved in the longitudinal direction.

Certainly also other elements like shock absorbers steel springs, pneumatic cylinders or similar are feasible which, however, are more expensive.

Thus, the contact element can be received between two combined spring-damper elements like e.g. rubber blocks or one or plural spring-damper elements of the type recited supra are arranged between two contact elements of the bearing block that are offset in the longitudinal direction.

The properties of the connection unit are further improved when the pivot axis about which each transversal strut is pivotable relative to its bearing block is not only arranged in longitudinal direction at a slant angle relative to horizontal but additionally a linking point of the transversal strut on the pivot axis is arranged as far down on the bearing block as possible in particular so that it protrudes downward into the elevation range of the skid or is at the most 20 mm above the rotation axis of the skid. Thus, the vertical lever is minimized and rotations of the skid about the longitudinal axis are reduced or avoided.

In particular in order to obtain a reset force towards the normal position during edging each connection unit advantageously does not only have one transversal strut but two transversal struts that are arranged parallel to one another wherein the transversal struts are connected with one another through elastic reset elements, for example rubber blocks.

When displacing a transversal strut about its pivot axis, thus at the bearing block or also when moving the two transversal struts in their longitudinal extension relative to one another this respectively causes a reset force into the normal position. For this purpose the pivot axes of the two transversal struts are offset relative to one another at each end of the connection unit by 10-20 mm, in particular by approximately 15 mm.

This behavior is additionally facilitated and stabilized in that the pivot axes extend in longitudinal direction but neither extend horizontally nor vertically relative to horizontal wherein all pivot axes of the connection unit have the same slant angle.

It is furthermore advantageous that both transversal struts of a connection unit have identical length wherein an identical edging of the skids is provided in both directions. Advantageously the two bearing blocks are combined at one end of the connection unit to form a common bearing block which simplifies the structural arrangement.

The transversal struts are configured rigid at least in a direction perpendicular to their pivot axis, however, they can be resilient thus spring elastic in a direction of the pivot axis.

The transversal struts are advantageously not directly attached with their ends at the pivot joints but have downward oriented extensions, for example made from circular bar stock which are for example welded to the tube material of the transversal struts which are supported with their free ends in the pivot joints of the bearing blocks.

Additionally the transversal struts are configured rotatable about the longitudinal axis of the protrusions which is necessary when a step offset of the skids is provided in the longitudinal direction in addition to the edging movement.

The protrusions facilitate a larger distance of the transversal struts in upward direction relative to the skids which is necessary in order to facilitate a sufficient edging of the skids without the skids contacting the transversal struts with one of their lower edges.

A piece of winter sport equipment with two coupled skids can be produced with two of the connection units described supra, for example in that a respective connection unit is mounted at a pair of skis in front and behind the commercially available bindings. The connection units are also easily dismountable so that the piece of winter sport equipment can be used optionally with and without coupling.

With respect to longitudinal move ability of the connection units on the sliding skids and their spring and damping effect the damping effect is advantageously adjusted to that it is stronger when moving the respective end of the connection unit towards the binding than when moving it away from the binding, thus at least 10% stronger, better at least 50% stronger, better at least 80% stronger, however, at the most 200% stronger, better at the most only 150% stronger.

The connection units are thus advantageously mounted so that the pivot axes respectively slope upward from the binding in forward and the backward direction.

The transversal struts are advantageously formed slightly arcuate thus bent in upward direction. This creates a large amount of clearance for edging the sliding skids.

Furthermore the reset forces between the transversal struts, thus the reset elements arranged thereon are selected so that a stronger reset effect, thus stronger reset elements or more reset elements are provided at the rear connection unit compared to what is provided at the forward connection unit. Besides different reset effects the two connection units can be configured identical.

C) EMBODIMENTS

Figure 1B:
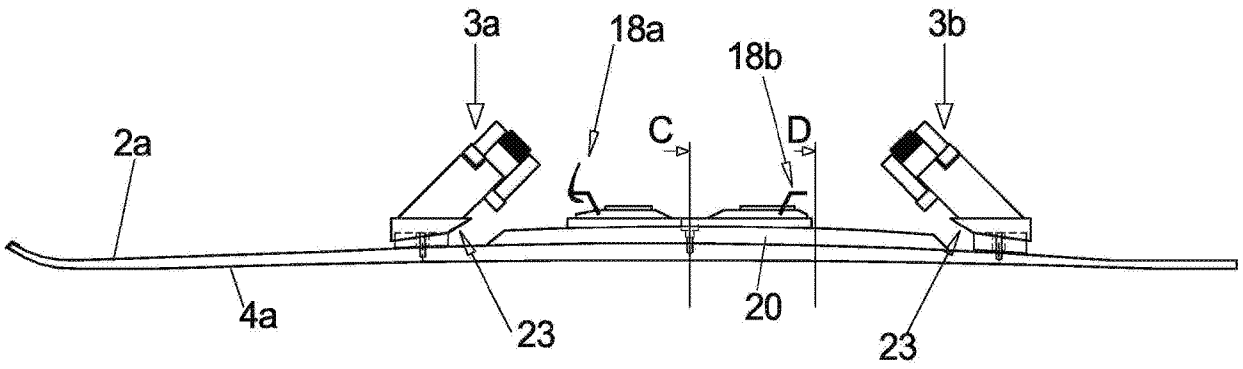
Figure 1C:
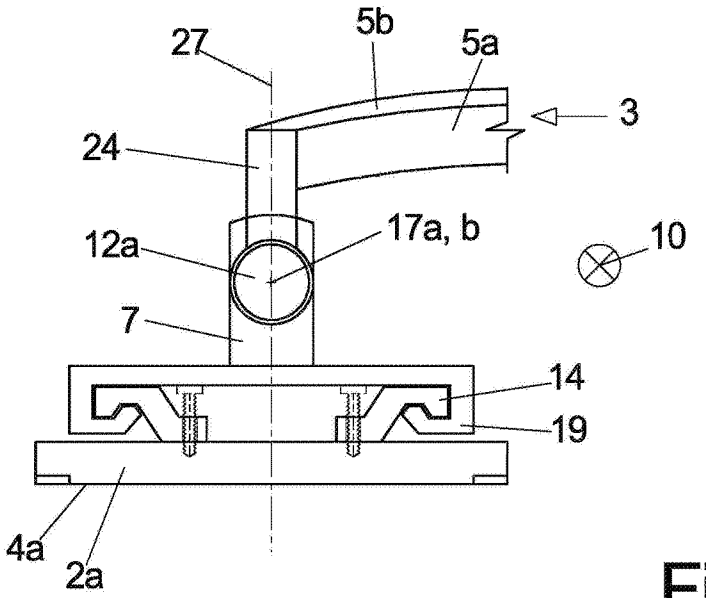
Figure 1D:
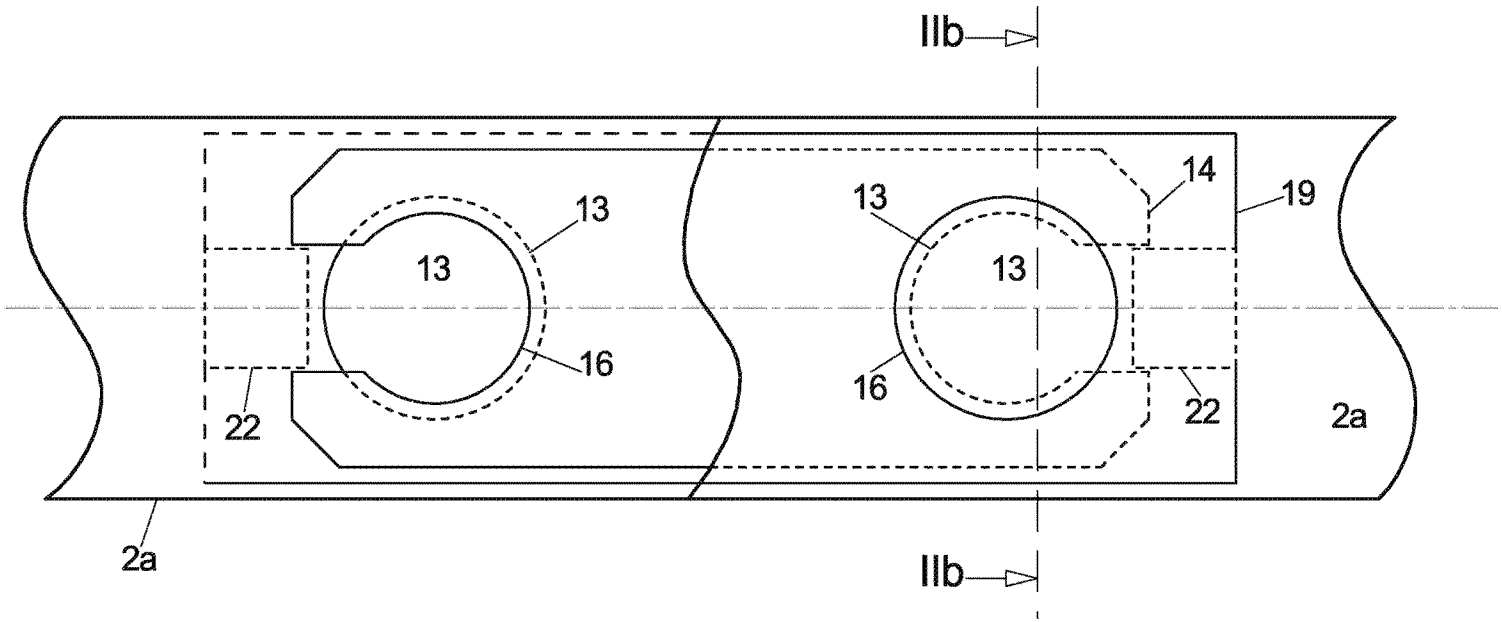
Figure 1E:
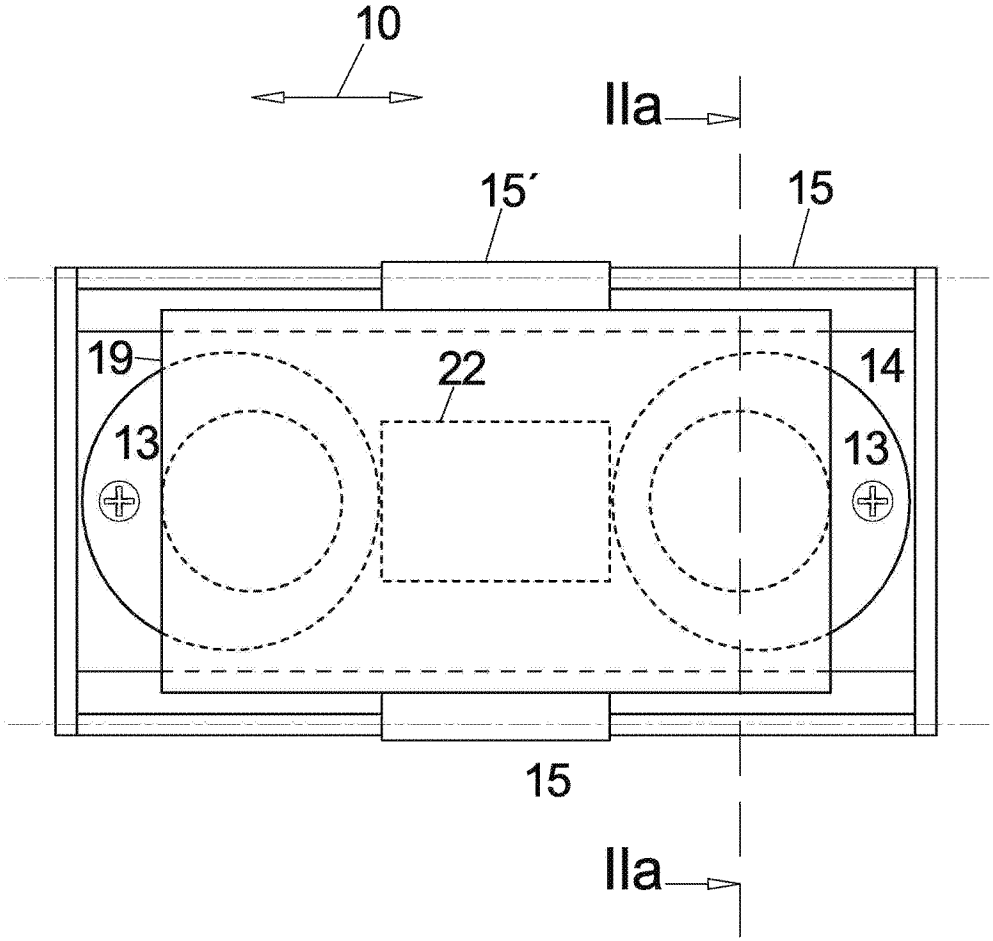
Figure 2A:
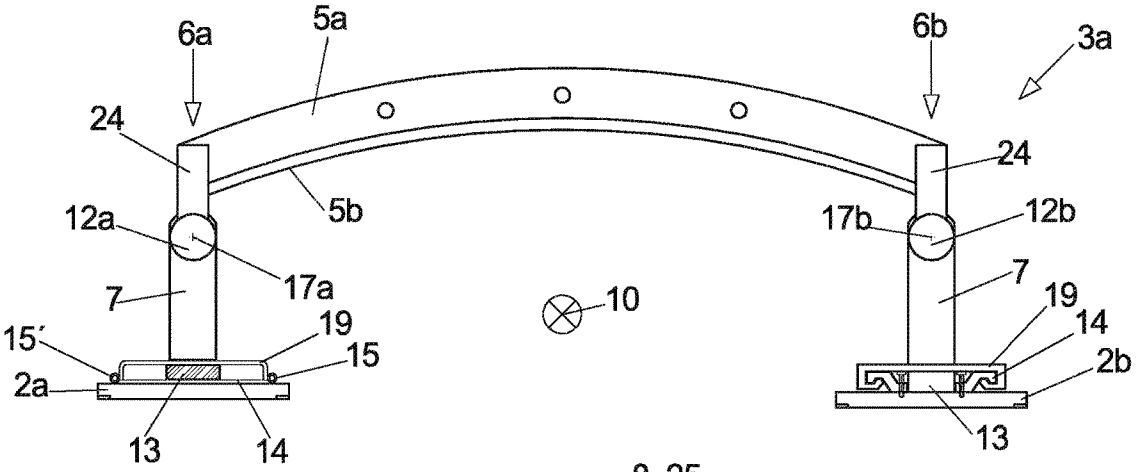
Figure 2B:
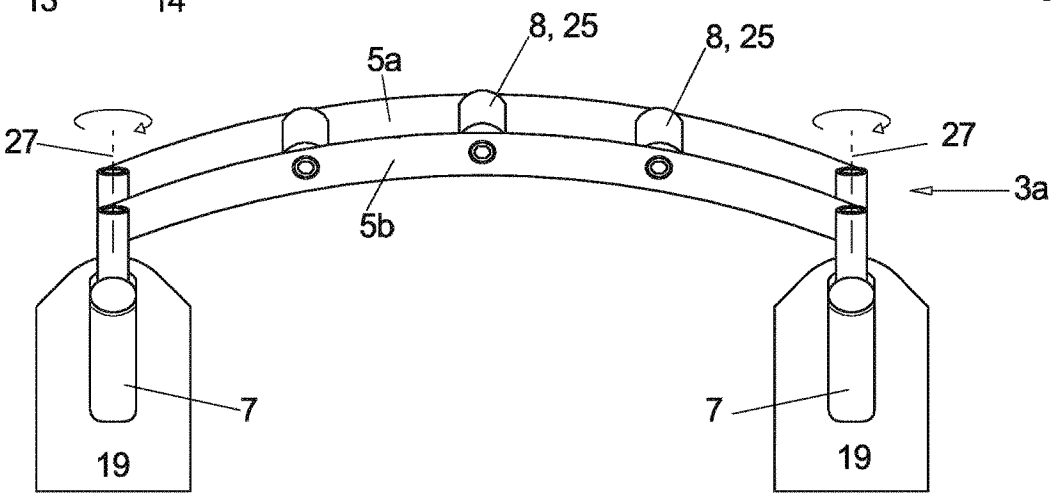
Figure 2D:
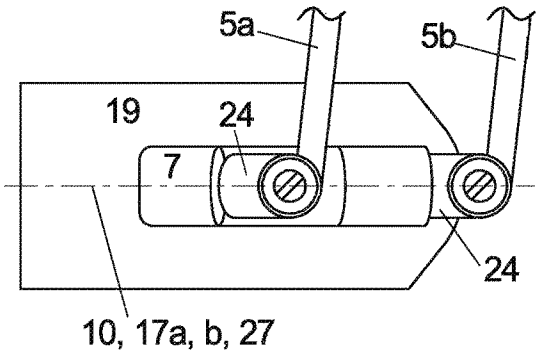
Figure 2C:
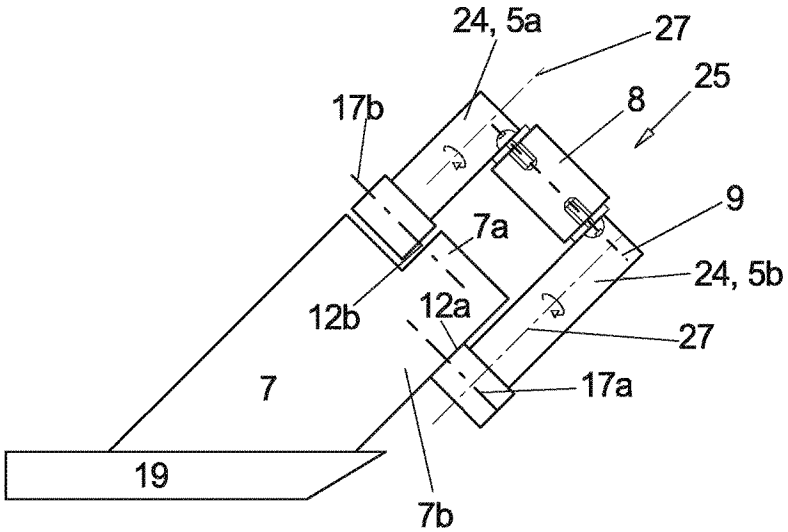

Embodiments of the invention are subsequently described in more detail with reference to drawing figures, wherein:

FIG. 1*a* illustrates a piece of winter sport equipment according to the invention in top view;

FIG. 1*b* illustrates the piece of winter sport equipment according to the invention in a lateral view;

FIG. 1*c, d* illustrates a first embodiment of the connection unit in a detail view;

FIG. 1*e* illustrates a second embodiment of the connection unit in a detail view;

FIG. 2*a* illustrates an individual connection unit in a frontal view and in a rear view;

FIG. 2*b* illustrates an individual connection unit in a top view;

FIG. 2*c* illustrates the connection unit in a side view, and

Figure 3A:
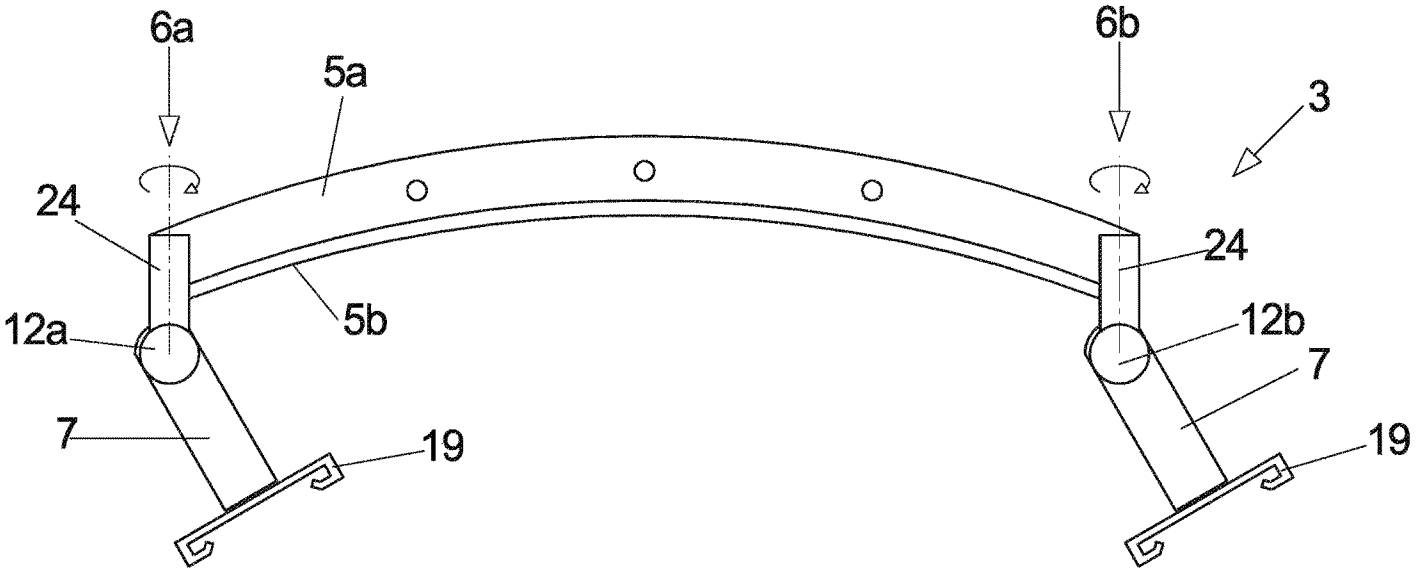
Figure 3B:
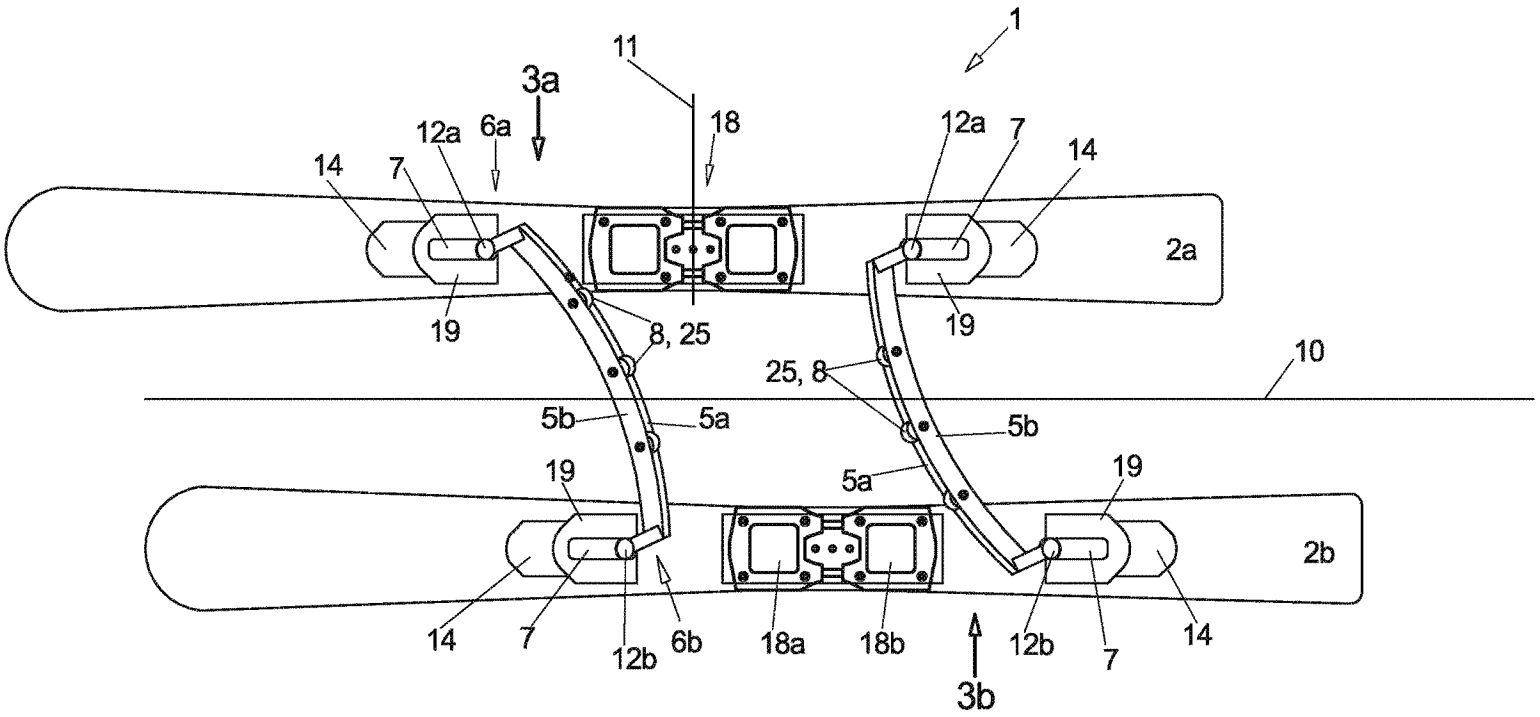

FIG. 2*d* illustrates a bearing block in top view;

FIG. 3*a* illustrates a connection unit in edged condition;

FIG. 3*b* illustrates the piece of winter sport equipment with step offset in top view.

For better comprehension the piece of winter sport equipment 1 is initially described as a whole and the connection unit 3*a, b* is described in general and the description of the spring-damper unit according to the invention is provided at the end based on reference to FIGS. 1*d, e*.

As illustrated in FIGS. 1*a* and *b*, the piece of winter sport equipment according to the invention is made from two skids 2*a, b* extending in longitudinal direction parallel adjacent to one another, wherein the user is attached respectively with one foot thus boot on a respective skid and which are connected with one another by two transversally extending connection units 3*a, b* one in front of the bindings 18 for the boots and one behind the bindings 18 for the boots.

The two skids 2*a, b* respectively carry a commercial safety binding in their center portion wherein the safety binding in this case includes a binding plate 20 which is attached on a top side of the skid 2*a, b* and forward and rear binding jaws 18*a, b* that are applied in the rear portion and front portion of the binding plate, wherein the boot is fixated between the binding jaws.

Connection units 3*a, b* are arranged in front of the forward binding jaw 18*a* and the rear binding jaw 18*b* wherein the connection units respectively extend transversally from one skid 2*a* to another skid 2*b*, wherein the connection units are respectively attached with one of their ends at one of the skids 2*a, b*.

As apparent best from FIGS. 2*a-d* each of the connection units 3*a, b* in this case is made from two transversal struts 5*a, b* whose long cross sectional axis is arranged at a slant angle to the main plane of the sliding skids.

The transversal struts 5*a, b*, are respectively pivotably supported with their free ends 6*a, b* in a bearing block 7*a, b* configured as a pivot joint 12*a, b*, which are combined on each side to form a common bearing block 7 and wherein each bearing block 7 is attached on one of the two skids 2*a, b* as best evident from FIGS. 1*a, b*.

The pivot axes 17*a, b* of the ends 6*a, b* of the transversal struts 5*a, b* in the bearing block 7*a, b* thus extend in longitudinal direction 10 of the sliding skids 2*a, b*, however advantageously not in parallel to the approximately horizontal main plane of the piece of winter sport equipment which corresponds to the contact surface of the sliding surfaces 4*a, b* of the sliding skids 2*a, b* in the neutral position on flat ground but is inclined thereto at an angle of approximately 0-60° thus sloping downward in this case to the center of the ski thus to the binding 13.

When edging the skids 2*a, b* as illustrated for example in FIG. 3*a* the two transversal struts 5*a, b* are moved relative to one another in transversal direction 11. Rubber elements 8 are arranged herein as reset elements 25 between the two transversal struts 5*a, b*, for example in their center portion and attached with one respective end of these for example cylindrical rubber elements 8 at one of the transversal struts 5*a, b* in particular threaded or also volcanized thereon.

Thus in an extension of transversal struts 5*a, b* plural rubber elements 8 can be arranged for this purpose in particular prefabricated pass through bore holes can be provided in the transversal struts 5*a, b*.

Since the pivot axes 17*a, b* of the two transversal struts 5*a, b* extend in the slotted holes 7*a, b* as apparent from FIGS. 2*c* and *d*, thus respectively in top view in the longitudinal direction 10, in side view however they are offset relative to one another in the longitudinal direction 10 and are advantageously oriented parallel to one another. Each connection unit 3*a, b* with its two transversal struts 5*a, b* represents a force parallelogram.

This has the consequence that when edging one of the skids, e.g. 2*a*, thus pivoting the skid 2*a* about its longitudinal axis 10 relative to the two connection units 3*a, b* attached thereon, also the other skid 2*b* edges in the same direction of rotation due to the force parallelogram of the connection unit thus the other skid edges about the longitudinal axis 10 which facilitates practical applications.

In case a length of the two transversal struts 5*a, b* of a connection unit 3*a, b* is identical, the two skids 2*a, b* are also edged by the same angle.

The transversal struts 5*a, b* are thus made e.g. from a flat material, in particular from steel, aluminum, titanium and spring steel. Protrusions 24 extend from the in particular arcuate upward cambered transversal struts 5*a, b* at ends in downward direction to the bearing block 7*a, b* and are pivotably supported about the pivot axis 27 at their free ends at the pivot joint 12*a, b*.

The cylindrical rubber elements 8 are thus bolted down with their longitudinal axes extending essentially parallel to the pivot axis 17*a, b* in the bearing block 7 between the flat transversal struts 5*a, b* where they contact respectively with one of their faces. Thus, the rubber elements 8 respectively have the same slant angle at their rubber axes 9 like the pivot axis 17*a, b* and the cross section of the flat transversal struts 5*a, b* and the protrusions 24 have an inverse slant angle relative to the skid 2*a, b* since they extend at a right angle relative to the direction of the pivot axis 17 *a, b* and the rubber elements 8.

In order to bring the transversal struts 5*a, b* into alignment with respect to the longitudinal axis of the rubber elements 8 instead of an offset of the pivot axis 17*a, b* in longitudinal direction 10 the protrusions 24 of the two transversal struts 5*a, b* are provided with different lengths as apparent from FIG. 2*c*.

Furthermore the transversal struts 5*a, b* are pivotable about the longitudinal extension of the protrusions 16*a, b* which are bolted down transversally protruding at the pivot joint 12 *a, b* for this purpose and the threaded connection is used for another pivot axis which is necessary since the two skids cannot only be edged relative to one another but can also have an offset in longitudinal direction 10 for the desired relative step movement.

FIG. 2 *a* illustrates a connection unit in a front view, so that the slightly arcuate transversal strut 5*a, b* is visible from its broad side with three bore holes in this case for possibly bolting down one respective rubber element 8. Each end of the transversal strut 5*a, b* terminates with its protrusion 16*a, b* attached thereto in one of the bearing blocks 7, thus a pivot link 12*a, b*.

FIG. 3*a* illustrates the connection unit in the same viewing direction as FIG. 2*a* that means from the front, however with bearing blocks which are arranged at a slant angle, this means displaced about the pivot axes 17*a, b* relative to the transversal struts 5*a, b* and thus placed at a slant angle analogously as it is the case when edging the piece of winter sport equipment with two skids.

FIG. 2*b* additionally also illustrates the three rubber elements 8 that are bolted down, in this case between the transversal struts 5*a, b*.

As apparent best from the side view in FIG. 1*b* a typical situation of a binding plate 20 between the actual ski binding 2*a, b* is used as a starting point for attaching the connection units 3*a, b* on the skids 2*a, b*.

Thus one binding plate 20 which is significantly longer than the actual ski binding is attached on the skid 2*a* or *b* in that it is bolted down firmly in the center relative to the skid 2*a* or *b* in a side view.

The forward and rear ends of the binding plate 20 are also bolted down relative to the skid 2*a, b* in order to support them at the skid, however the bolt head can move along a top side of the binding plate 20, for example in a longitudinal groove which is necessary when the skid 2*a, b* is bent in vertical direction, which can change the distance between the central threaded connection and the forward or rear connection. This shape does not stiffen the skid 2*a, b* in its center portion to an impermissible extent and can then still be vertically deformed at this location.

The actual binding including the forward and rear binding vice 18*a, b* is then only bolted down on the binding plate 20, the threaded connection, however, does not reach into the skid 2*a, b*.

Since the binding plate 20 is longer than the actual binding 18 the connection units 3*a, b* a can be applied in a portion in front and behind the binding on the binding plates 20 in case the binding plates are provided and long enough however the connection units 3*a, b* can also be attached separately and directly on the sliding skids 2*a, b* as illustrated in the drawing figure.

However attaching the connection units 3*a, b* on the binding plate 20 is simpler:

Namely the binding plates 20 are often configured so that the binding vices 18*a, b* only have to be pushed in longitudinal direction 10, e.g. from behind onto the binding plates 20 already bolted onto the sliding skid and are then already fixated in a form locking manner in all transversal directions 11 in that the binding plate 20 as evident from FIG. 1*c* has a cross section wherein the binding plate is bolted with a bottom side of the cross section onto the skid 2*a* or *b*. Thus, the cross section includes downward elbowed outer walls which do not quite reach the top side of the skid 2*a, b* so that a respective downward open contour of the bottom side of the binding vices 18*a, b* as illustrated in FIG. 1*c* can reach under this downward elbowed edge in a form locking manner so that it is fixated in a form locking manner in a horizontal transversal direction 11 and also in the vertical direction.

In the same manner, thus with the same C shaped profile at a bottom side of each bearing block plate 19 for sliding in longitudinal direction 10 onto the binding plate 20 which then simultaneously forms the base plate 14 or a separate base plate 14 configured analogously at the edges which is then bolted onto the respective skid 2*a, b*, each bearing block 7 of the connection unit 3*a, b* can be configured so that also the connection units 3*a, b* can be simply slid on in longitudinal direction 10 and can be secured at the desired position solely by introducing vertical clamping screws 21.

A particularity of the invention is represented by the attachment of the bearing blocks 7 which are moveable within limits in the longitudinal direction 10, advantageously also spring loaded and dampened, thus of their bearing blocks plates 19 relative to the skids 2*a,b*.

A first embodiment is illustrated in FIG. 1*e* and FIG. 2*a* at the left bearing block 7.

The base plate 14 that is fixated with bolts on the skid 2*a* includes support rods at its lateral edges wherein the support rods extend in the longitudinal direction 10 and have for example a circular cross section and are used as a longitudinal support for the base plate. Furthermore rubber elements configured as combined spring-/damper elements 13 are bolted onto the base plate 14 and are offset in longitudinal direction 10 and are configured in this case as approximately annular discs which are bolted onto the base plate 14 with their outer ends that are oriented away from the center of the base plate 14.

In longitudinal direction 10 the bearing block plate 19 is attached above the base plate 14 moveable relative thereto wherein the bearing block plate includes a support sleeve 15' at its ends wherein the support sleeve is supported on the support rods 15. In a center of the bearing block plate 19 arranged above the base plate 14 a stop element 22 protrudes from the bearing block plate in downward direction between the rubber elements 13 with a length that corresponds to a distance between the rubber elements 13.

In case the bearing block plate 19 is moved in longitudinal direction 10 either due to uneven ground or for other reasons it presses against one of the rubber elements 13 and compresses it which dampens the longitudinal movement of the bearing block plate 19 increasingly and is subsequently moved back into its initial position due to the elasticity of the rubber element 13 which has a spring effect in that the rubber element unloads again.

The bearing blocks 7 and thus the connection units 3 are moveable within limits relative to the skids 2 which prevents a buildup of resonances or a transfer of resonances from a skid 2*a* to another skid 2*b*.

FIG. 1 *d* and FIG. 2*a* right side illustrate an even simpler embodiment with the same effect.

The base plate 14 is in turn fixated again through bolts on the skid 2*b* and includes the downward elbowed rims which do not reach the skid as illustrated and described in FIG. 1*c*. There above and supported moveable in longitudinal direction 10 relative thereto there is the bearing block plate 19 which reaches under the edges of the base plate 14 with its lateral rims so that the bearing block plate 19 is supported in the longitudinal direction 10.

In the end portions in longitudinal direction 10 of the base plate 14 there are recesses 16 which are open towards the faces of the base plate 14 and additionally for example towards the top side and/or to the bottom side of the base plate 14. In these recesses 16 for example disc shaped fitted rubber elements 13 are inserted which are kept in position for example through an overreaching edge of the base plate 14.

At ends of the bearing block plate 19 a stop element 22 respectively extends downward from the bearing block plate again into the elevation level of the rubber elements 13 and with a width which is less than the opening width of the recesses 16 in the base plate 14.

Thus, when the bearing block plate 19 is moved in the longitudinal direction 10 one of the stop elements 22 presses against one of the rubber elements 13, deforms it and is thus dampened with respect to its movement and the spring elastic reverse movement of the rubber element 13 presses the bearing block plate 19 back again in its neutral position in which the stop elements 22 contact the respective rubber elements 13 advantageously without any preload.

The spring and damping functions that are combined in the rubber element 13 can also be implemented separately, for example by a spiral spring and a hydraulic damper which however makes the structure much more complex.

FIG. 1 *c* illustrates a mere longitudinal movability between the base plate 14 and the bearing block plate 19 without spring or damping.

REFERENCE NUMERALS AND DESIGNATIONS

1 winter sport equipment
2 *a, b* skid
3 *a, b* connection unit
4*a, b* sliding surface
5 *a, b* transversal strut
6 *a, b* free end
7 *a, b* bearing block
8 rubber element
9 rubber axis
10 longitudinal direction
11 transversal direction
12 *a, b* pivot joint
13 spring-/damper element, rubber element
14 base plate
15 longitudinal support
16 recess
17 *a, b* pivot axis
18 binding
18 *a, b* binding jaw
19 bearing block plate
20 binding plate
21 clamping screw
22 stop element
23 compensation device
24 protrusion
25 reset element
26
27 pivot axis

The invention claimed is:

1. A connection unit (3) for moveably connecting two skids (2*a, b*) extending parallel adjacent to one another in a longitudinal direction (10) typically in a horizontal direction and forming a piece of winter sport equipment (1), the connection unit comprising:

at least one transversal strut (5*a, b*) extending transverse to the longitudinal direction (10) and having a free end (6*a, b*) on each side;

at least one bearing block (7*a, b*) at each free end (6*a, b*) of each transversal strut (5*a, b*) in which bearing block the transversal strut (5*a, b*) is supported pivotable about a pivot axis (17*a, b*) that is oriented in a longitudinal direction (10) in top view;

a base plate (14) for attaching on one of the skids (2*a, b*) which supports the bearing block (7*a, b*);

characterized in that the transversal strut (5*a, b*) is attached moveable within limits in the longitudinal direction (10) and/or the transversal direction (11) through a compensation device (23) relative to the base plate (14) supporting the transversal strut, wherein said compensation device includes a spring element or a damper element.

2. The connection unit (3) according to claim 1, characterized in that the compensation device (23) is arranged between the bearing block (7*a, b*) and the respective base plate (14) or alternatively between the bearing block (7*a, b*) and the transversal strut (5*a, b*).

3. The connection unit (3) according to claim 1, characterized in that the compensation device (23) causes a movability in the longitudinal direction (10) and/or in the transversal direction (11) through a linear movement, or a pivoting about a vertical compensation axis at which a respective transversal strut (5*a, b*) is eccentrically mounted with its end.

4. The connection unit (3) according to claim 1, characterized in that the compensation device (23) includes both said spring element and said damper element (13) and an effective direction of the spring element and the damper element coincide and the effective direction coincides with the moving direction of the compensation device (23).

5. The connection unit (3) according to claim 1, characterized in that the compensation device (23) or a spring element (24) or a damper element (13) are respectively effective in all three directions in space.

6. The connection unit (3) according to claim 1, characterized in that the compensation device (23) or a spring element or a damper element are respectively only effective in the longitudinal direction (10) and the transversal direction (11) of the sliding surface (4*a, b*) of the skids (2*a, b*).

7. The connection unit (3) according to claim 4, characterized in that the spring element and the damper element are respectively only effective in the longitudinal direction (10) in the positive and also in the negative longitudinal direction (10).

8. The connection unit (3) according to claim 4, characterized in that a maximum travel of the spring element and/or the damper element is +/−60 mm at the most, but at least +/−3 mm.

9. The connection unit (3) according to claim 4, characterized in that an effect of the spring element or of the damper element is adjustable.

10. The connection unit (3) according to claim 1, characterized in that each bearing block (7*a, b*) is supported in longitudinal direction (10) and/or in transversal direction (11) on both sides relative to the skids (2*a, b*) in the longitudinal direction (10) in longitudinal supports (15) at the base plate (14) and in particular there between in the center a spring element or a damper element is arranged on a longitudinal center of the skids (2*a, b*).

11. The connection unit (3) according to claim 1, characterized in that the base plate (14) or the bearing block plate (19) include open recesses (16) that are open towards its forward and rear face wherein the recesses are also open in downward direction for inserting combined spring-/damper elements (13), made from an elastic material.

12. The connection unit (3) according to claim 1 including two transversal struts (5*a, b*) and at least one reset element (25) which becomes effective either when displacing one of the transversal struts about its pivot axis (17*a, b*) in the bearing block (7*a, b*), or during a movement of the two transversal struts (5*a, b*) relative to one another respectively in a direction of their reset into their normal positions.

13. The connection unit (3) according to claim 1, characterized in that the pivot axis (17*a, b*) is arranged in parallel or at a slant angle relative to the longitudinal direction (10) and the position of the pivot axis (17*a, b*) is arranged as far downward in the bearing block (7*a, b*) as possible, protruding with the joint (12*a, b*) into the elevation range of the skid (2*a, b*).

14. The connection unit (3) according to claim 1, characterized in that a slant angle of all four pivot axes (17*a, b*, 17'*a, b*) at both ends of the connection unit (3) is identical or the two bearing blocks (7*a, b*) at one end of the connection unit (3) are combined in a common bearing block (7).

15. The connection unit (3) according to claim 12, characterized in that the reset element (25) includes at least one spring element and one damper element optionally functionally combined with the spring element and the reset element is made from an elastic material, and/or one or plural reset elements (25), in particular rubber blocks (8) are arranged between the two transversal struts (5*a, b*) and in case of one rubber block (8) are respectively attached with a face at one of the transversal struts (5*a, b*).

16. The connection unit (3) according to claim 1, characterized in that the transversal struts (5*a, b*) are rigid in one direction perpendicular to the pivot axis (17*a, b*) of the bearing blocks (7*a, b*) thus not spring elastic and are spring elastic in a direction of the pivot axes (17*a, b*) or the transversal struts (5*a, b*) have protrusions (24) at their ends wherein the protrusions are oriented downward at a slant angle and extend in a plane of the transversal struts wherein the protrusions are pivotable with their free ends about a pivot axis (27) relative to the pivot joint (12).

17. The connection unit (3) according to claim 1, characterized in that the pivot axes (17*a, b*) are offset relative to one another by 10-20 mm, and the pivot axes (17*a, b*) include an angle between 0° and 60°, relative to the horizontal longitudinal direction (10).

18. The connection unit (3) according to claim 16, characterized in that the pivot axes (27) enclose an angle between 30° and 90°, relative to the horizontal longitudinal direction (10) and—the at least one transversal strut (5*a, b*) is length adjustable.

19. A piece of winter sport equipment comprising:

two skids (2*a, b*) on which a user is attached with one respective boot with a binding (18), one respective connection unit according to claim 1 in front and behind the bindings (18) which connect the two skids (2*a, b*) with one another in a transversal direction (11), characterized in that both connection units (3*a, b*) include a compensation device (23), wherein each said compensation device includes a spring element or a damper element.

20. The piece of winter sport equipment according to claim 19, characterized in that for an effective direction of said spring element or said damper element in the longitudinal direction (10) for at least one of the connection units (3*a, b*) the damping effect when moving towards the binding (18) is stronger than away from the binding (18) in particular at least 10% stronger, however at the most 200% stronger.

21. The piece of winter sport equipment according to claim 19, characterized in that the pivot axes (17*a, b*) are arranged at a slant angle relative to the horizontal longitudinal direction (10) so that they taper downward towards the center of the skids (2*a, b*), thus the bindings (18) and an effect of the reset elements (25) between the transversal struts (5*a, b*) at the rear connection unit (3*b*) is stronger than at the forward connection unit (3*a*).

22. The piece of winter sport equipment (1) according to claim 19, characterized in that the forward connection unit (3*a*) and the rear connection unit (3*b*) are identical, and the transversal struts of the rear connection unit (3*b*) are longer than the transversal struts of the forward connection unit (3*a*).

* * * * *